United States Patent [19]

Burroughs

[11] Patent Number: 4,902,021

[45] Date of Patent: Feb. 20, 1990

[54] CHECKER AND DICE GAME

[76] Inventor: Robert C. Burroughs, 20400 Frederick Rd., Lot 1-2, Germantown, Md. 20874

[21] Appl. No.: 336,914

[22] Filed: Apr. 11, 1989

[51] Int. Cl.[4] ..... A63F 3/02

[52] U.S. Cl. ..... 273/260

[58] Field of Search ..... 273/260, 261, 243; D21/24

[56] References Cited

U.S. PATENT DOCUMENTS 885,588 4/1908 Dehls ..... 273/243
1,228,542 6/1917 Durbin ..... 273/260
3,794,326 2/1974 Bialek ..... 273/260
2,453,9907 11/1948 Hare et al. ..... 273/260

FOREIGN PATENT DOCUMENTS 1593287 7/1981 United Kingdom ..... 273/260

*Primary Examiner*—Edward M. Coven
*Assistant Examiner*—Benjamin Layno

[57] ABSTRACT

This invention, a checker and dice board game introduces a new method of checker playing whereby numbered checkers correspond with numbers on a pair of thrown dice. Consequently, the dice when thrown will determine which checkers qualify to be moved.

8 Claims, 1 Drawing Sheet

FIG. 1
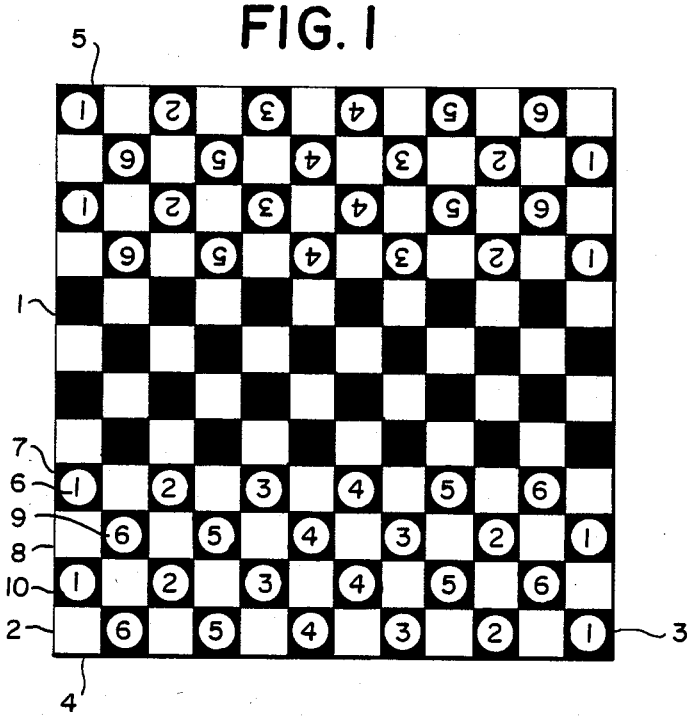
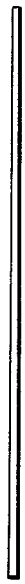
FIG. 2
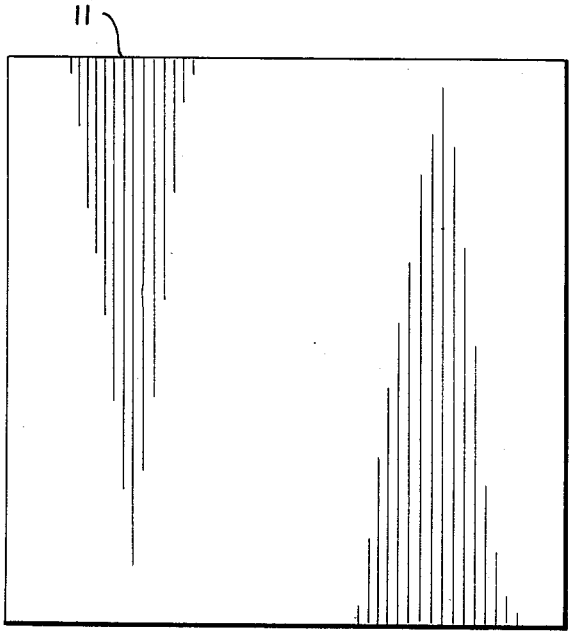
FIG. 3
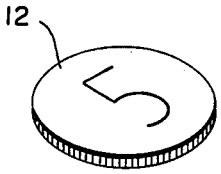
FIG. 4
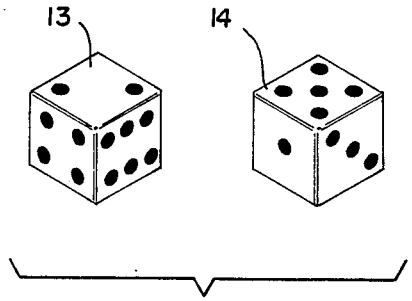
FIG. 5

CHECKER AND DICE GAME

SUMMARY OF THE INVENTION

This game was designed to introduce a new dimension of strategy to the well known game of checkers. Since there are a limited number of basic moves that can be made on a checkerboard with either checkers or chess, and when it is considered that computers have been successfully designed to defeat even the best of chess players there would appear to be a need for a new dimension to be added that would prevent plays from becoming boringly automatic. It is towards this end numbered checkers and correspondingly numbered dice have been introduced into this new game of Checkers 'N Dice.

Each player starts the game with four sets of checkers numbered from one through six giving said player a total of 24 checkers. This is double the number of checkers used on a standard checkerboard. Consequently, a larger checkerboard is incorporated into this board game having 144 checkered squares.

Moves are made by first throwing the dice. The player then moves two checkers that match the two numbers on the thrown dice. In the event that a double number is thrown he has the choice of moving either one or two of these same numbered checkers, but he is not allowed to move one checker two places.

As the game progresses a player may find himself in the position where he can't fulfill his two moves as all of the qualifying checkers of a given number may be blocked in so that they cannot be moved. If this occurs the player must make the one move he may be able to make, and that will complete his turn. If he cannot make either one of the two moves he forfeits his turn and the opposing player takes his turn. However, he must make an open move even if it means moving into a position where his opponent will be able to jump his checker.

When a player sees that he can jump his opponent's checker or checkers he can make the jump in lieu of the thrown dice as the jump counts as a turn. However, he is not required to jump against his will unless he throws the number on his dice to match the numbered checker he can jump, and that is his only move for that numbered checker.

The game is not won by the jump of the last checker. It is won by the player who first scores 60 points or more. Points are made by jumping your opponent's checkers. The number on each checker jumped is added together with other numbers of jumped checkers until the numbers on all of the jumped checkers of your opponent totals 60 points or more.

When a king is crowned it may be moved forward or backwards as in standard checkers. An opponent crowns the opposing player's king with whatever checker he prefers to use that he has jumped. This, of course, would usually be the smallest numbered checker he has jumped, as he would have to forfeit the points that checker represents, and he wants to give up as few points as possible. However, there may be times when a player may want to crown his opponent's king with a higher number if his opponent has no checkers left on the board with that number. That would make it easy to set a trap for that given king if he has only that numbered piece to move if he throws the corresponding number on the dice. Whatever number he crowns the king with will represent the movable number as it relates to the throw of the dice. When a king is jumped the player making the jump claims the total of both of the numbers of the two checkers of the king to add to his score.

A further object of the invention is to bring more depth of strategy into play.

A further object of the invention is to provide more opportunities for optional choices of risky and daring moves.

A further object of the invention is to broaden the scope of play.

A further object of the invention is to provide excitement in the movement of the checkers by the unpredictable throw of the dice.

Other objects and advantages will become apparent from a consideration of the following description and the appended claims in conjunction with the accompanying drawings wherein:

DESCRIPTION OF THE PREFERRED EMBODIMENTS

FIG. 1 is a top plan view of the checkerboard with its numbered checkers positioned at start of game.

FIG. 2 is a side elevation view showing the edge of the checkerboard.

FIG. 3 is a bottom plan view of the checkerboard.

FIG. 4 is a top perspective view of a numbered checker.

FIG. 5 is a perspective view of the pair of dice.

With continued reference to the drawings FIG. 1 represents a top plan view of the checkerboard 1 having horizontally and vertically disposed lines creating 12 vertical and 12 horizontal rows of 144 checkered squares.

The first horizontal row of checkered squares begins at 2 and terminates at 3.

The first vertical row of checkered squares begins at 4 and terminates at 5.

The checkers are positioned by each player at the start of the game in the first four rows from the lower edge of the checkerboard 1 relative to and adjacent to the player's sitting position.

Reading from left to right the first checker 6 on the fourth horizontal row 7 from the lower edge would be numbered 1 with the remaining checkers in said fourth horizontal row following a sequence of numbers reading from left to right 1-2-3-4-5-6.

The third horizontal row 8 from the lower edge would have 6 more checkers positioned in sequence in reverse order of reading from left to right 6-5-4-3-2-1, the first checker 9 being numbered 6.

The second horizontal row 10 from the lower edge would have 6 more checkers positioned in sequence reverting back in a like manner to the fourth horizontal row 7 reading from left to right 1-2-3-4-5-6.

The first horizontal row 2 from the lower edge would have 6 more checkers positioned in reverse sequence as indicated in the third horizontal row 8.

FIG. 3 reveals the reverse side 11 of the checkerboard 10.

A numbered checker 12 is shown in perspective in FIG. 4.

The dice 13 and 14 are shown in perspective in FIG. 5.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A checker and dice game comprising a game board, checkers and at least one die, said game board having a checkered layout to position said checkers, said checkers being numbered individually to match individual corresponding numbers on the face sides of said die, the movement of said checkers having a corresponding function with the throw of said die.

2. A checker and dice game as described in claim 1, there being a plurality of said dice with which the movement of said checkers has a coordinating function.

3. A checker and dice game as described in claim 2, said checkered layout comprising substantially square geometrical shapes.

4. A checker and dice game as described in claim 3, said checkered layout comprising 144 of said substantially square geometrical shapes.

5. A checker and dice game as described in claim 3, said checkers totaling 24 in number for each participant at start of game.

6. A checker and dice game as described in claim 1, said checkered layout comprising substantially square geometrical shapes.

7. A checker and dice game as described in claim 6, said checkered layout comprising 144 of said substantially square geometrical shapes.

8. A method of playing a checker and dice game comprising the steps of:

providing a checkerboard, at least one die, each face of said die having identifying indicia, and a plurality of checkers, each being marked with one of said identifying indicia;

rolling said die to determine which correspondingly marked checkers is to be moved.

* * * * *